US009447621B2

(12) United States Patent
Kalinowski

(10) Patent No.: US 9,447,621 B2
(45) **Date of Patent: *Sep. 20, 2016**

(54) INTERCONNECTION SYSTEM FOR PANEL ASSEMBLIES

(71) Applicant: AAR Manufacturing, Inc., Wood Dale, IL (US)

(72) Inventor: Ramon Kalinowski, New Braunfels, TX (US)

(73) Assignee: AAR Manufacturing, Inc., Wood Dale, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/737,236

(22) Filed: Jun. 11, 2015

(65) Prior Publication Data

US 2015/0275559 A1 Oct. 1, 2015

Related U.S. Application Data

(63) Continuation of application No. 14/475,218, filed on Sep. 2, 2014, now Pat. No. 9,062,486, which is a continuation of application No. PCT/US2012/027597, filed on Mar. 2, 2012.

(51) Int. Cl.
*E05D 1/04* (2006.01)
*E05D 11/10* (2006.01)
(Continued)

(52) U.S. Cl.
CPC ..... *E05D 11/1007* (2013.01); *E05D 1/04* (2013.01); *E05D 3/02* (2013.01); *E05D 5/02* (2013.01);
(Continued)

(58) Field of Classification Search
CPC ..... E05D 1/00; E05D 1/04; E05D 1/06; E05D 7/10; E05D 11/10; Y10T 16/535; Y10T 16/536; Y10T 16/53605; Y10T 16/53615; Y10T 16/5362; Y10T 16/53625
See application file for complete search history.

(56) References Cited

U.S. PATENT DOCUMENTS 731,138 A * 6/1903 Stearns ..... 52/72
1,068,422 A * 7/1913 Fish ..... 16/260
(Continued)

FOREIGN PATENT DOCUMENTS

EP 1072750 A1 1/2001
FR 2259955 8/1975
WO WO 9420714 A1 * 9/1994 ..... E05D 3/06

OTHER PUBLICATIONS

Moon, Kihwan "International Preliminary Report on Patentability (Chapter 1 of the Patent Cooperation Treaty)," dated Sep. 2, 2014, Applicant Name: Vantem Modular, LLC, Applicant File Ref: P-10214PCT; International Application No. PCT/US2012/027597; International Filing date Mar. 2, 2012.

*Primary Examiner* — Jeffrey O Brien
(74) *Attorney, Agent, or Firm* — Barne & Thornburg LLP

(57) ABSTRACT

A system for interconnecting multiple panel assemblies comprising a first bracketing body having a first bearing member and at least one planar member; a second bracketing body having a second bearing member pivotally engaged with the first bearing member and at least one planar member; a third bracketing body having at least one planar member; a fourth bracketing body having at least one planar member; a first panel receiving volume at least partially defined by the at least one planar member of the first and third bracketing bodies; a second panel receiving volume at least partially defined by the at least one planar members of the second and fourth bracketing bodies; and wherein the at least one planar members of the second and fourth bracketing bodies at least partially define a second panel receiving volume. According to another aspect of the present invention, a first thermal insulating body is positioned between and separates the first and third bracketing bodies, and a second thermal insulating body positioned between and separates the second and fourth bracketing bodies. According to yet another aspect of the present invention, a fastenerless connection is provided between surfaces of the system and the panel assemblies.

16 Claims, 15 Drawing Sheets

(51) Int. Cl.

| | |
|---|---|
| ***E05D 3/02*** | (2006.01) |
| ***E05D 5/02*** | (2006.01) |
| ***E05D 5/14*** | (2006.01) |
| ***E05D 11/06*** | (2006.01) |
| *E05D 15/24* | (2006.01) |
| *E04B 1/344* | (2006.01) |

(52) U.S. Cl.

CPC ..... *E05D 5/14* (2013.01); *E05D 11/06* (2013.01); *E04B 1/344* (2013.01); *E05D 15/242* (2013.01); *E05Y 2800/12* (2013.01); *E05Y 2900/142* (2013.01); *Y10T 16/53615* (2015.01); *Y10T 16/54* (2015.01); *Y10T 16/54035* (2015.01); *Y10T 16/558* (2015.01); *Y10T 16/5518* (2015.01); *Y10T 16/5547* (2015.01)

(56) References Cited

U.S. PATENT DOCUMENTS

| | | | | | |
|---|---|---|---|---|---|
| 2,302,661 | A | * | 11/1942 | Benson | 16/267 |
| 2,365,378 | A | * | 12/1944 | Benson | 16/264 |
| 2,641,018 | A | * | 6/1953 | Snyder | 16/356 |
| 2,658,233 | A | * | 11/1953 | Kimmel | 16/269 |
| 2,852,802 | A | * | 9/1958 | Seby | 16/356 |
| 3,423,787 | A | * | 1/1969 | Horstman | 16/356 |
| 3,484,895 | A | * | 12/1969 | Mock | 16/356 |
| 3,663,990 | A | * | 5/1972 | Shane | 16/269 |
| 3,696,463 | A | * | 10/1972 | Watson | 16/356 |
| 4,315,345 | A | * | 2/1982 | Schijf | 16/267 |
| 4,694,533 | A | * | 9/1987 | Doyen | 16/257 |
| 4,748,783 | A | * | 6/1988 | Labelle | 52/592.4 |
| 4,852,213 | A | | 8/1989 | Shewchuk | |
| 4,942,271 | A | * | 7/1990 | Corsi et al. | 174/101 |
| 5,220,951 | A | * | 6/1993 | Dagenais | 160/199 |
| 5,329,667 | A | * | 7/1994 | Erskine | 16/269 |
| 5,809,617 | A | * | 9/1998 | Harris et al. | 16/273 |
| 5,942,729 | A | | 8/1999 | Carlson, Jr. et al. | |
| 6,145,165 | A | | 11/2000 | Torcato | |
| 6,338,181 | B1 | * | 1/2002 | Hwang | 16/266 |
| 6,389,629 | B1 | * | 5/2002 | Schouest | 14/69.5 |
| 6,499,188 | B1 | * | 12/2002 | Cheng | 16/269 |
| 6,687,956 | B1 | * | 2/2004 | Foo | 16/269 |
| 6,691,370 | B2 | | 2/2004 | Tatara | |
| 6,951,237 | B2 | * | 10/2005 | Mullet | 160/201 |
| 7,013,530 | B2 | * | 3/2006 | Lallemant | 16/297 |
| 7,341,305 | B2 | * | 3/2008 | Reynard | 296/186.4 |
| 7,380,310 | B2 | * | 6/2008 | Koessler | 16/267 |
| 7,653,969 | B2 | * | 2/2010 | Erskine et al. | 16/365 |
| 7,984,594 | B1 | * | 7/2011 | Propst | 52/309.12 |
| 8,052,000 | B2 | | 11/2011 | Apps | |
| 8,863,360 | B2 | * | 10/2014 | Mukherjee et al. | 16/353 |
| 2003/0200628 | A1 | * | 10/2003 | Tatara | 16/355 |
| 2006/0288532 | A1 | * | 12/2006 | Kim, II | 16/267 |
| 2009/0032280 | A1 | | 2/2009 | Owens et al. | |
| 2013/0019913 | A1 | | 1/2013 | Zadok et al. | |
| 2013/0312918 | A1 | * | 11/2013 | Trenkler | 160/138 |

* cited by examiner

INTERCONNECTION SYSTEM FOR PANEL ASSEMBLIES

CROSS REFERENCE TO RELATED APPLICATIONS

This application is a continuation of and claims the benefit of U.S. patent application Ser. No. 14/475,218 filed Sep. 2, 2014, which is a continuation application of and claims the benefit of and priority to PCT Application No. PCT/US2012/027597 filed Mar. 2, 2012 which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to foldable, connectable panel assemblies for use in building structures and other structures where the panel assemblies may be utilized. More specifically, the present invention relates to a system for interconnecting panel assemblies, providing for rotatability of one panel assembly relative to another around an axis of rotation, and providing for securing the interconnection of one panel assembly with respect to another panel assembly in a fixed, lockable relationship. Additionally, this invention provides with a fastenerless connection between the construction panel its perimeter trims.

2. Description of the Related Art

Pre-fabricated, foldable, portable building structures have been developed to enable shipment of structures in a collapsed form while facilitating the erection of those buildings at their installation site. One objective in developing pre-fabricated, foldable, portable buildings is to provide for maximum square footage of erected structure while retaining a minimum volume and weight of the structure in its collapsed form for shipping purposes. This avoids the unnecessary transportation of air volume within the structure, resulting in more economical transportation of such structures. At the same time, hingedly joining components of the structure to fold when collapsed facilitates erection of these structures at the erection site by unskilled labor at considerable cost and time saving.

The successful development and introduction of containerized transportation, involving the loading of fixed-dimension containers aboard land, sea, and air modes of transportation specially adapted for standard container sizes, has provided considerable cost benefit and generally provides safer and quicker worldwide freight transportation. The I.S.O. freight containers have been universally adopted by most modern modes of transportation, and practically every country in the world is now capable of handling and delivering such containers, making it possible to economically ship I.S.O. freight containers to practically any destination in the world.

Given the benefits associated with containerized transportation, the development of a pre-fabricated, foldable, portable building that is collapsible to fit within the outside dimensions of shipping containers meeting I.S.O standards is desirable. One problem associated with the development of a pre-fabricated, foldable, portable building is a sufficiently robust and maneuverable interconnection system for interconnection of panel assemblies that compose the foldable building.

Current designs for interconnection systems are not maximally efficient in terms of use of the available space, do not interconnect panel assemblies with adequate fixation, resulting in weak connections, create unwanted heat transfer at the connections of adjacent panel assemblies, and inadequately seal the space between sides of the panel assembly to prevent fluid flow therebetween. Accordingly, there exists a need for an optimized panel assembly that addresses such deficiencies.

BRIEF SUMMARY OF THE INVENTION

The present invention system for interconnection multiple panel assemblies comprises a first bracketing body having a first bearing member and at least one planar member; a second bracketing body having a second bearing member pivotally engaged with the first bearing member and at least one planar member; a third bracketing body having at least one planar member; a fourth bracketing body having at least one planar member; a first panel receiving volume at least partially defined by the at least one planar member of the first and third bracketing bodies; a second panel receiving volume at least partially defined by the at least one planar members of the second and fourth bracketing bodies; and wherein the at least one planar members of the second and fourth bracketing bodies at least partially define a second panel receiving volume. According to another aspect of the present invention, a first thermal insulating body is positioned between and separates the first and third bracketing bodies, and a second thermal insulating body positioned between and separates the second and fourth bracketing bodies. According to yet another aspect of the present invention, a fastenerless connection is provided between surfaces of the system and the panel assemblies.

DETAILED DESCRIPTION OF THE INVENTION

Figure 1:
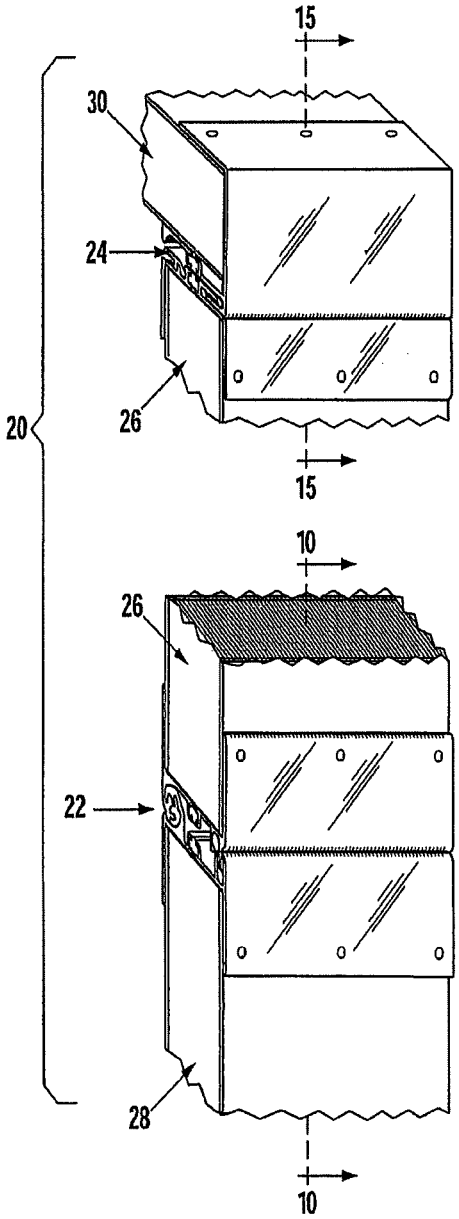
FIG. 1 is a perspective view of the preferred embodiment of the present invention.

FIG. 1 depicts a preferred embodiment 20 of the present invention, which comprises a hinge assembly 22 and a connection assembly 24 interconnecting a first panel assembly 26, a second panel assembly 28, and a third panel assembly 30. The hinge assembly 22 interconnects the first and second panel assemblies 26, 28 and provides rotational movement of the first panel assembly 26 relative to the second panel assembly 28 between the first relative position shown in FIG. 1 and a second relative position. The connection assembly 24 interconnects the first panel assembly 26 and the third panel assembly 30 in a fixed relative position in which the first panel assembly 26 is orientated at a right angle relative to the third panel assembly 30, such as, for example, would be found at the intersection of a sidewall and a ceiling of a building.

Figure 2:
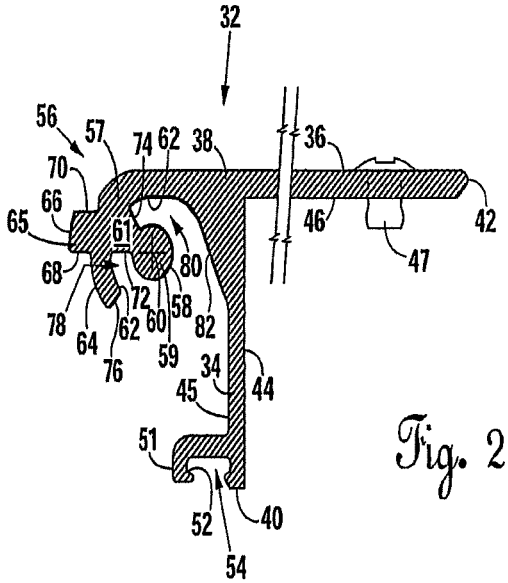
FIG. 2 is a sectional elevation of a bracketing body of the preferred invention.

FIGS. 2-14 depict the basic structure and operation of the preferred hinge assembly 22 in greater detail. While FIGS. 2-14 are sectional views of a specific profile of the hinge assembly 22, it should be understood that any profile through the hinge assembly 22 is identical. As shown in FIG. 2, the hinge assembly 22 comprises a first bracketing body 32 having first and second planar members 34, 36 intersecting at a first junction 38 in a perpendicular relationship. As used herein, "bracketing body" means a body for attachment to one or more sides of the member to be bracketed in order to fix the relationship so that the attached member securely moves with the bracketing body as the bracketing body is moved, or alternatively so that the bracketing body securely moves with the attached member is moved. First and second planar members 34, 36 have first and second free ends 40, 42, respectively, distal from the first junction 38 and also comprise first and second planar engaging surfaces 44, 46 intersecting in a right angle at the first junction 38. As used herein, "planar member" means a member having at least one planar surface, and "engaging surface" means a surface having a profile with a shape at least generally corresponding to the shape of the surface of an object member to which the engagement surface is to be proximally positioned for the purpose of fixing the body with the "engagement surface" to the object member. The terms "engaging surface" and "planar surface" are not intended, however, to exclude the incorporation of additional panel engaging members proximal to or extending from the surface, such as the use of teeth or ridges as described elsewhere herein, to provide further fixation functionality between the body and the object member.

The first bracketing 32 body is preferably fixed to a panel assembly with fasteners, such as rivets 47. Alternative embodiments contemplate panel engaging members, in conjunction with or instead of fasteners, extending from the engaging surfaces. In one alternative embodiment of the first bracketing body 32, shown in FIG. 3, a first set of normal ridges extends from the first engaging surface 44 and a first set of angled ridges 48 extends from the second engaging surface 46 toward the first engaging surface 44. Each of the ridges 48, 50 extends along the length of the engaging surface 44, 46. In another alternative embodiment, a plurality of individualized extruded teeth extends normally or at an angle from the first and second engaging surfaces 44, 46.

A first channel beam 51 having a generally C-shaped cross section is formed integrally with and extends from the free end 40 to the first planar member 34. A non-engaging surface 45 of the first planar member 34 opposite its engaging surface 44 and the channel beam 51 has a concave interior curved surface 52 which defines a first insulating volume 54. Still referring to FIG. 2, the first bracketing body 32 has a first bearing member 56 which extends from the first junction 38 opposite of the second planar member 36 and comprises a curved first bearing arm 57 partially surrounding and spaced from a generally cylindrical hinge pin 59. The first bearing arm 57 is connected to the hinge pin 59 by a bridging member 61.

The hinge pin 59 has a convex first bearing surface 58 having a first radius R1 from a first axis 60. The bearing arm 57 has interior second bearing surfaces 62 having a second radius R2 from the first axis 60 and a convex exterior third bearing surface 64 having a third radius R3 from the first axis 60. The bearing arm 57 terminates at an end surface 76 extending between the second and third bearing surfaces 62, 64.

A stop member 65 extends from the exterior third bearing surface 64. This stop member 65 comprises two preferably parallel opposing first and second stopping surfaces 68, 70 extending between the third bearing surface 64 and a convex fourth bearing surface 66 having a fourth radius R4 from the first axis 60.

Figure 3:
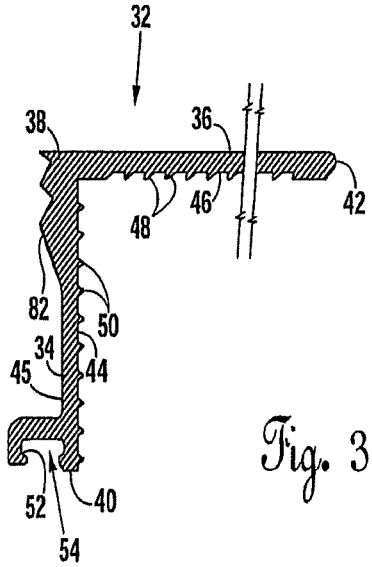
FIG. 3 is a sectional elevation of an alternative embodiment of the bracketing body shown in FIG. 2.
Figure 4:
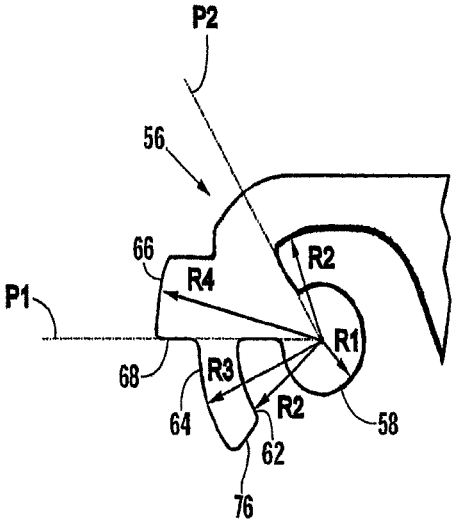
FIG. 4 shows the relationship between the bearing surfaces of the bracketing body shown in FIG. 2.

As shown jointly in FIGS. 2-4, all of the bearing surfaces 58, 62, 64, 66 are partially-cylindrical and concentric around the first axis 60. The magnitude of the first radius R1 is less than the magnitude of the second radius R2, which is less than the magnitude of the third radius R3, which is less than the magnitude of the fourth radius R4.

First and second inner stopping surfaces 72, 74 comprise the sides of the bridging member 61 and extend between the first and second bearing surfaces 58, 62. Each of the first and second inner stopping surfaces 72, 74 are coplanar with reference planes P1, P2 extending through the first axis 60. A first partially-toroidal slot 78 is defined by the first inner stopping surface 72 and the first and second bearing surfaces 58, 62. A second partially-toroidal slot 80 is defined by the second inner stopping surface 74 and the first and second bearing surfaces 58, 62. A planar first support surface 82 is positioned adjacent to the second bearing surface 62 and extends between the non-engaging surface 45 of the first planar member 34 and the second bearing surface 62.

Figure 5:
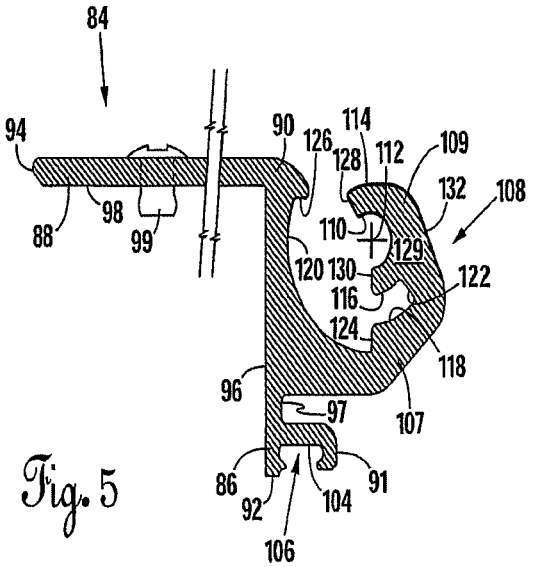
FIG. 5 is a sectional elevation of a second bracketing body of the preferred invention.

Referring to FIG. 5, the hinge assembly 22 further comprises a second bracketing body 84 having third and fourth planar members 86, 88 intersecting at a second junction 90 in a perpendicular relationship. The third and fourth planar members 86, 88 have free ends 92, 94 distal from the second junction 90 and also comprise a third and fourth planar engaging surfaces 96, 98 intersecting in a right angle at the second junction 90.

The second bracketing body 84 is preferably fixed to a panel assembly with fasteners, such as a row of rivets 99. Alternative embodiments contemplate panel engaging members, in conjunction with or instead of fasteners, extending from the engaging surfaces. In one alternative embodiment of the second bracketing body 84, shown in FIG. 6, a second set of normal ridges 102 extends from the third engaging surface 96 and a second set of angled ridges 100 extends from the fourth engaging surface 98 toward the third engaging surface 96. Each of the ridges 100, 102 extend along the length of the corresponding engaging surface 96, 98. In another alternative embodiment, a plurality of individualized extruded teeth extends normally or at an angle from the first and second engaging surfaces 96, 98.

A second channel beam 91 having a generally C-shaped cross section is formed integrally with and extends from a non-engaging surface 97 of the third planar member 86 adjacent its free end 92. The second channel beam 91 has a concave interior curved surface 104 which defines a second insulating volume 106.

Still referring to FIG. 5, a second bearing member 108 which extends from the non-engaging surface 97 of the third member 86 comprises a curved second bearing arm 107 which terminates in a hinge barrel 109 having a generally semicircular, C-shape cross section and an interior concave fifth bearing surface 110 having a fifth radius R5 from a second axis 112. The hinge barrel 109 has a convex sixth bearing surface 114 having a sixth radius R6 from the second axis 112 and a convex seventh bearing surface 116 having a seventh radius R7 from the axis 112. The second bearing arm 107 has an interior, concave eighth bearing surface 118 having an eighth radius R8 from the axis 112 and an interior, concave ninth bearing surface 120 having a ninth radius R9 from the axis 112. The ninth bearing surface 120 extends between two stopping surfaces 124, 126 positioned on the second bearing arm 108.

Figure 6:
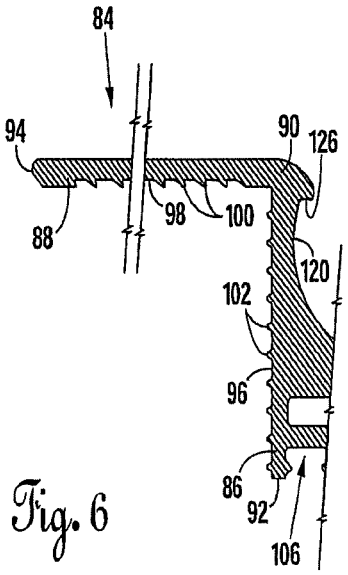
FIG. 6 is a sectional elevation of an alternative embodiment of the bracketing body shown in FIG. 3.
Figure 7:
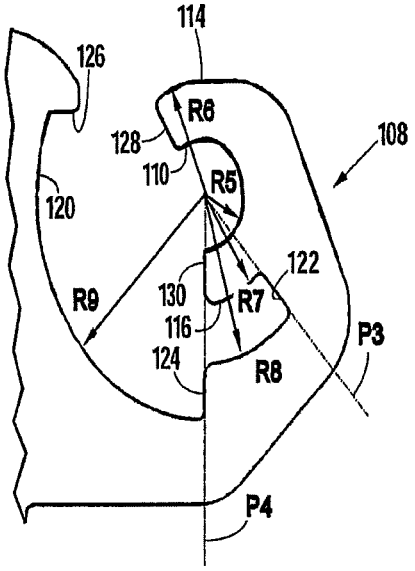
FIG. 7 shows the relationship between the bearing surfaces of the bracketing body shown in FIG. 3.

As shown in FIGS. 5-6, all of the bearing surfaces 110, 114, 116, 118, 120 are partially-cylindrical and concentric around the second axis 112. The magnitude of the fifth radius R5 is less than the magnitude of the sixth radius R6, which is equal to the magnitude of the seventh radius R7. The magnitude of the seventh radius R7 is less than the magnitude of the eighth radius R8, which is less than the magnitude of the ninth radius R9.

A first stopping surface 122 extends between the seventh and eighth bearing surfaces 116, 118 and is co-planar with a reference plane P3 extending radially through the second axis 112. The second stopping surface 124 extends between the eighth and ninth bearing surfaces 118, 120 and is co-planar with a reference plane P4 extending radially through the second axis 112. The third stopping surfaces 126 extends from the ninth bearing surface 120 and is positioned adjacent the second junction 90 of the third and fourth planar members 86, 88. The hinge barrel 129 has an outer end surface 128 which extends between the fifth and sixth bearing surfaces 110, 114, and an inner end surface 130 extends between the fifth and seventh bearing surfaces 110, 116. A planar second support surface 132 is positioned adjacent to the sixth bearing surface 114 forming a portion of the exterior surface of the second bearing arm 108.

Figure 8:
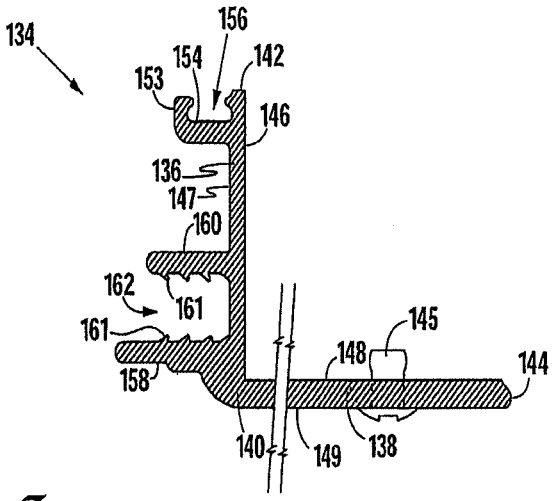
FIGS. 8-9 are sectional views of third and fourth bracketing bodies of the hinge assembly of the present invention.

FIG. 8 shows a third bracketing body 134 having fifth and sixth planar members 136, 138 intersecting at a third junction 140 in a perpendicular relationship. The fifth planar member 136 has a first planar engaging surface 146, a non-engaging surface 147 and a free end 142 distal from the third junction 140. Likewise, the sixth planar member 138 has a sixth planar engaging surface 148, non-engaging surface 149 and free end 144 distal from the third junction 140.

The third bracketing body 134 is preferably fixed to a panel assembly with fasteners, such as a row of rivets 145. Alternative embodiments contemplate panel engaging members (i.e., ridges or individualized extruded teeth), in conjunction with or instead of fasteners, extending from the engaging surfaces, as shown and described with reference to the first and second bracketing bodies 32, 84 and FIG. 3 and FIG. 6.

A third channel beam 153 having a generally C-shaped cross section is continuous and extends from and is formed integrally with the non-engaging surface 147 of the fifth planar member 136 proximal its free end 142. The third channel beam 153 has a concave interior curved surface 154 defining a third insulating volume 156.

First and second engagement fins 158, 160 extend generally perpendicular from the non-engaging surface 147 of the fifth planar member 136 to partially define therebetween a first sealing volume 162 proximal to the junction 140. Retaining members 161 are angle toward the fifth planar member 136 extend from the planar surfaces of the first and second engagement fins 158, 160 that define the sealing volume 162. In the preferred embodiment, the retaining members 161 are ridges. In alternative embodiments the retaining members 161 are a plurality of individualized extruded teeth.

Figure 9:
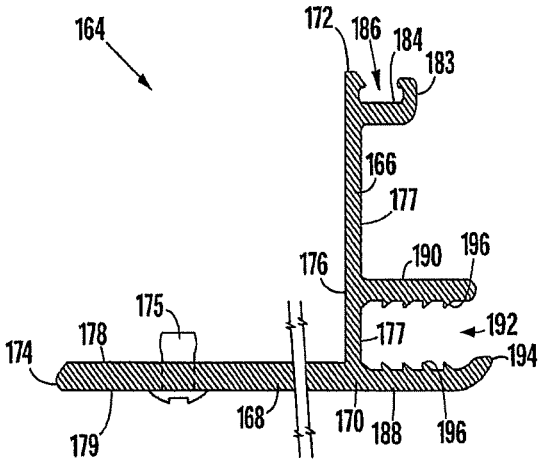

FIG. 9 depicts a fourth bracketing body 164 having seventh and eighth planar members 166, 168 intersecting at a fourth junction 170 in a perpendicular relationship. The seventh planar member 166 has a seventh planar engaging surface 176, a non-engaging surface 177, and a free end 172 distal from the fourth junction 170. Likewise, the eighth planar surface 168 has an eighth planar engaging surface 178, a non-engaging surface 179 and a free end 174 distal from the fourth junction 170. The seventh and eighth planar engaging surfaces 176, 178 intersect at a right angle.

The fourth bracketing body 164 is preferably fixed to a panel assembly with fasteners, such as a row of rivets 175. Alternative embodiments contemplate panel engaging members (i.e., ridges or individualized extruded teeth), in conjunction with or instead of fasteners, extending from the engaging surfaces, as shown and described with reference to the first and second bracketing bodies 32, 84 and FIG. 3 and FIG. 6.

A fourth channel beam 183, having a C-shaped cross section, is continuous with and extends from the non-engaging surface 177 of the seventh planar member 166 proximal its free end 172. The fourth channel beam member 183 has a concave interior curved surface 184 defining a fourth insulation volume 186.

Third and fourth engaging fins 188, 190 extend generally perpendicular from the non-engaging surface 177 of the seventh planar member 166 to define a second sealing volume 192 therebetween. The third engaging fin 188 is coplanar with the eighth planar member 168 and has a free end 194 that curves toward the fourth engagement fin 190.

Retaining members 196 angled toward the seventh member 166 extend from the planar surfaces of the third and fourth engagement fins 188, 190 that define the sealing volume 192. In the preferred embodiment, the retaining members 196 are ridges extending along the length of the planar surfaces. In alternative embodiments the retaining members 196 are a plurality of individualized extruded teeth.

Figure 10:
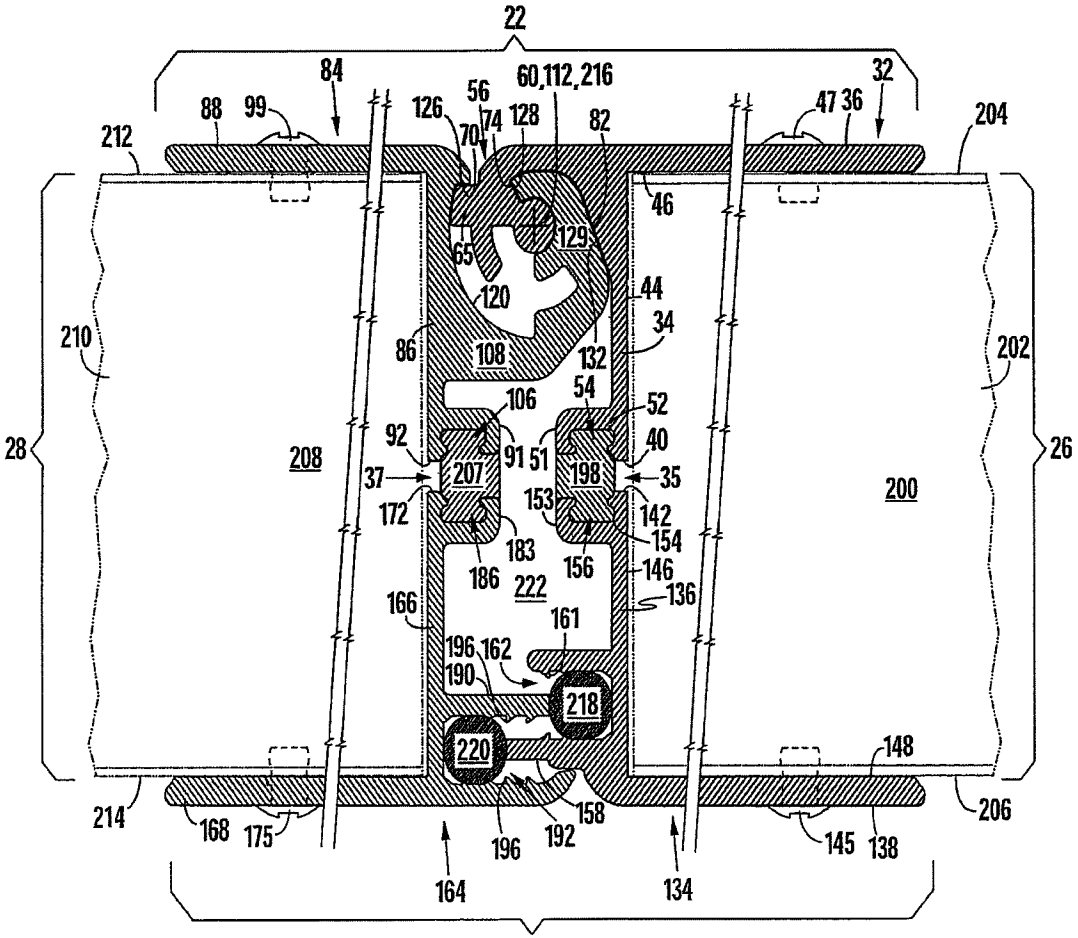
FIG. 10 is a sectional view of the hinge assembly shown in FIG. 1 from line 10-10 thereof in a first configuration wherein the interconnected panel assemblies are in coplanar alignment.

FIG. 10 shows the hinge assembly 22 of the present invention in its entirety, including the elements described previously with reference to FIGS. 2-9, in use with the first and second panel assemblies 26, 28. The first planar member 34 of the first bracketing body 32 is positioned adjacent the fifth planar member 136 of the third body 134 in coplanar alignment with a space 35 therebetween. The first and third bracketing bodies 32, 134 are oriented such that the second and sixth planar members 36, 138 extend from the first and third bodies 32, 134, respectively, in the same direction.

The first and third channel beams 51, 153 of the first and third bodies 32, 134, respectively, are mechanically connected with a first insulating body 198 positioned in a space between the first and third channel beams 51, 153. The first insulating body 198 is rigid, made of an insulative material such as a thermally nonconductive resin, portions of which are shaped to fit within the first and third insulating volumes 54, 156. Preferably, such a resin is poured into the insulating volumes 54, 156 and the space therebetween in a liquid state and allowed to harden. The interior curved surface 52, 154 of the first and third channel beam members 51, 153, respectively, secure the first and third bracketing bodies 32, 134 to the first insulating body 198.

The planar engaging surfaces 44, 46, 146, 148 of the first bracketing body 32 and the third bracketing body 134 form an assembly having a square U-shaped cross section which defines a first panel receiving volume 200. As shown in FIGS. 1 and 10, the first panel assembly 26 is positioned within the panel receiving volume 200 such that the sides of the first panel assembly 26 engage the planar engaging surfaces 44, 46, 146, 148 and are fastened with rows of rivets 47, 145

The first panel assembly 26 itself comprises a layer of insulative core material (e.g., polystyrene) 202 positioned between two reinforcing layers 204, 206 that provide structural rigidity to the intermediate layer 202. In the preferred embodiment, the first and second reinforcing layers are metallic.

In the same manner as described with regard to the first and third bracketing bodies 32, 134, the second and fourth bracketing bodies 84, 164 are mechanically connected with a thermally non-conductive second insulating body 207 wherein the second insulating body 207 is positioned between the second and fourth channel beams 91, 183 and secured with the second and fourth insulating volumes 106, 186. In this position, the third planar member 86 of the second body 84 is in co-planar alignment with the seventh planar member 166 with a space 37 between the respective free ends 92, 172. Also in this position, the fourth and eighth planar members 88, 168 of the second and fourth bracketing bodies 84, 164, respectively, extend in the same direction wherein the planar engaging surfaces 146, 148, 176, 178 of the second and fourth bracketing bodies 84, 164 form an assembly with a square U-shaped cross section defining a second panel receiving volume 208. One end of the second panel assembly 28, also comprising a layer of insulative core material 210 positioned between two preferably metallic reinforcing layers 212, 214, is positioned within the second panel receiving volume 208.

FIG. 10 shows the hinge assembly 22 in a first configuration wherein the first bearing member 56 and second bearing member 108 are interconnected and the first and second panel assemblies 26, 28 are in coplanar alignment. In this configuration, the first axis 60 described with reference to the first through fourth bearing surfaces 58, 62, 64, 66 (see FIG. 2) is coaxial with the second axis 112 described with reference to the fifth through ninth bearing surfaces 110, 114, 116, 118 (see FIG. 5) to form an axis of rotation 216. To prevent further rotation of the second bearing member 108 with respect to the first bearing member 56, the outer end surface 128 of the hinge barrel 129 is in contact with the second stopping surface 74 and the side stopping surface 70 of the stop member 65 is in contact with the third stopping 126.

Still referring to FIG. 10, the rubber sealing elements 218, 220 are positioned in the first and second sealing volumes 162, 192, respectively, to prevent fluid flow into an interior space 222 of the hinge assembly 22. The sealing element 220 is compressed and held within the second sealing volume 192 by the first engagement fin 158. The other sealing element 218 is compressed and held within the first sealing volume 162 by the fourth engagement fin 190. Retaining members 161, 196 inhibit movement of the sealing elements 218, 220 within the sealing volumes 162, 192.

Figure 14:
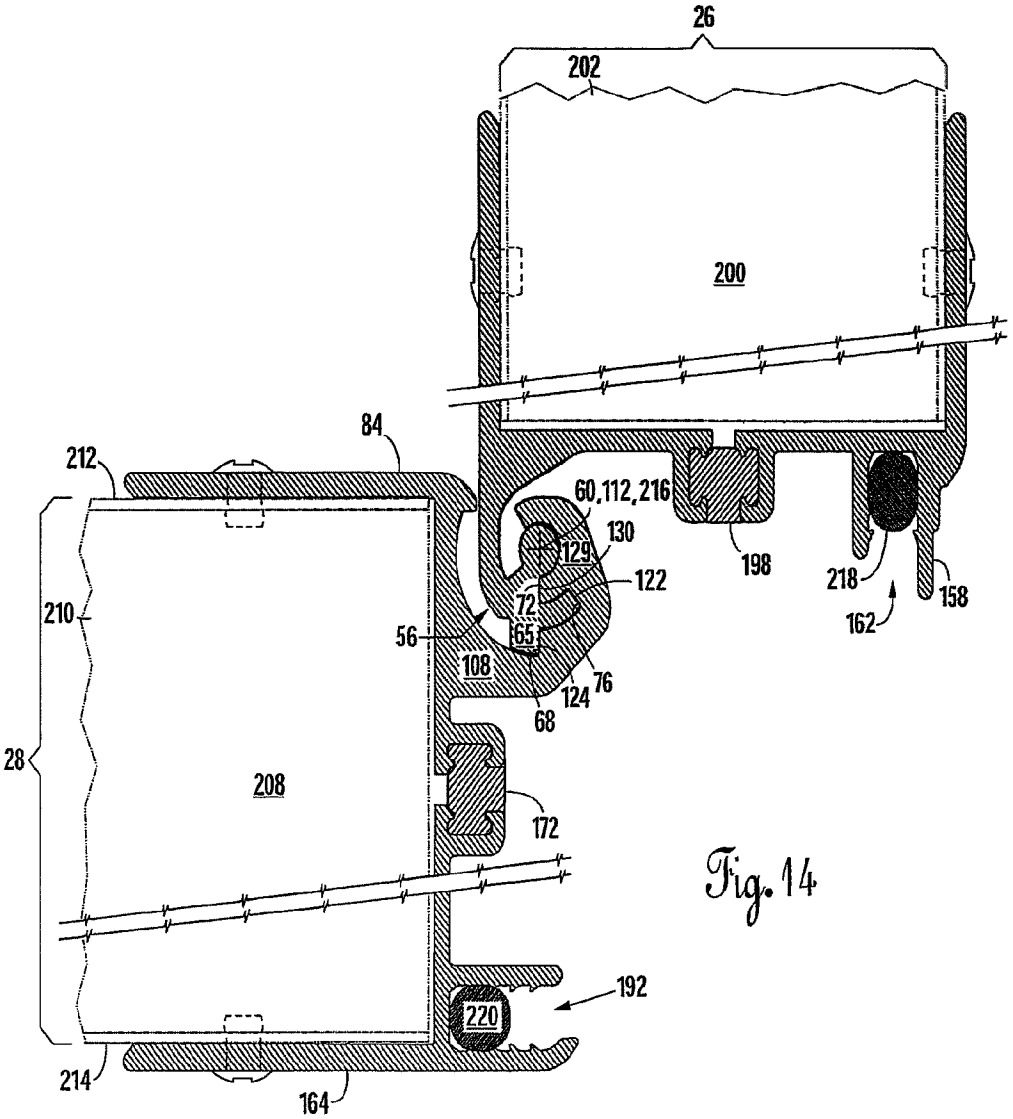
FIG. 14 is a sectional view of the hinge assembly shown in FIG. 1 in a second configuration wherein the interconnected panel assemblies are in a perpendicular relationship.

FIG. 14 shows the hinge assembly 22 in a second configuration wherein the first bearing member 56 and the second bearing member 108 are still interconnected and the second panel assembly 28 is at a right angle with respect to the first panel assembly 26. In this position, to prevent further rotational movement of the second bearing member 108 with respect to the first bearing member 56, the inner end surface 130 of the hinge barrel 129 contacts the first stopping surface 72 of the bearing member 56; the side stopping surface 68 of the stop member 65 is in contact with the second stopping surface 124; and end surface 76 of the first bearing member 56 is in contact with the stopping surface 122 of the second bearing member 108.

Use of the preferred embodiment of the hinge assembly 22 is initially described with reference to FIG. 10. First and second panel assemblies 26, 28 are positioned in the first and second panel receiving volumes 200, 208 respectively. Rows of rivets 47, 145 engage with the first panel assembly 26 to inhibit movement thereof. Likewise, rows of rivets 99, 175 engage the second structural member 28 to inhibit removal thereof.

Figure 11:
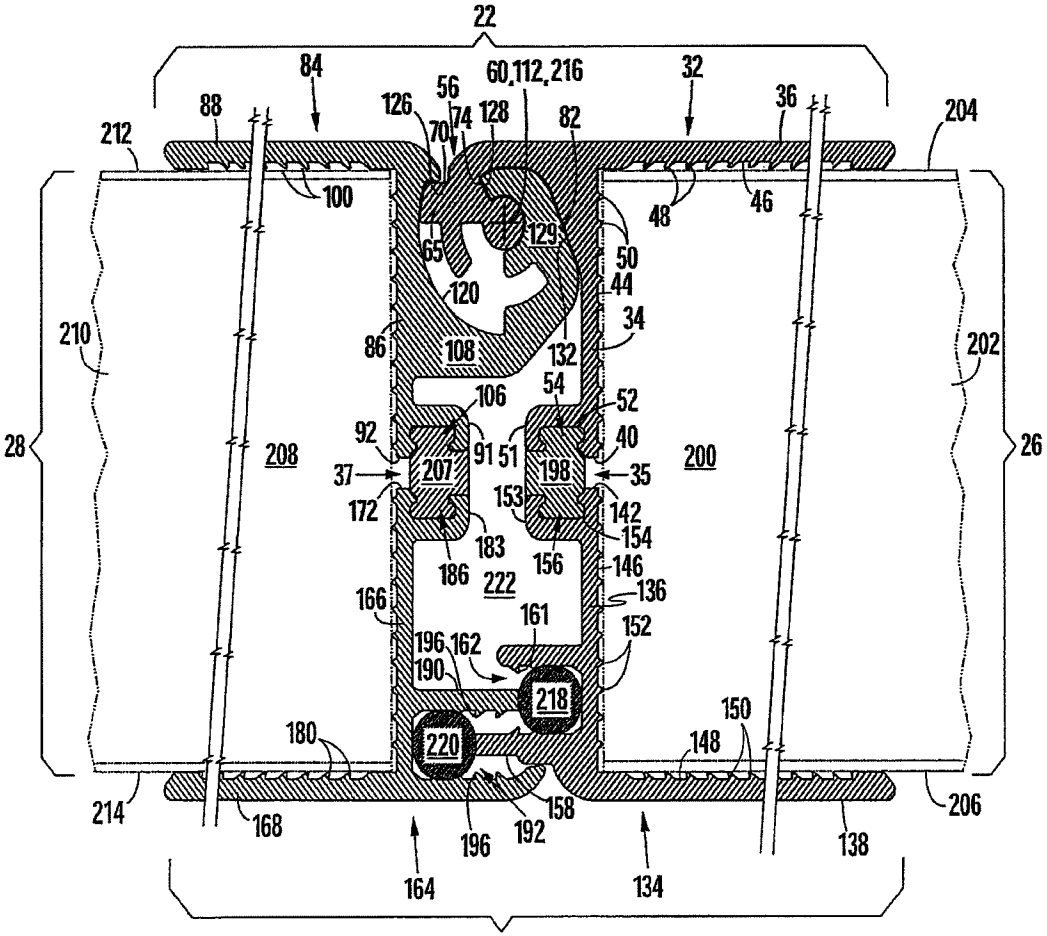
FIG. 11 is a sectional view of an alternative embodiment to the embodiment shown in FIG. 6 comprising planar engaging members extending into the panel receiving volumes.

As shown in FIG. 11, in an alternative embodiment, angled ridges 48, 150 and normal ridges 50, 152 within the first panel receiving volume 200 (described with reference to FIG. 3 and FIG. 6) engage with the first panel assembly 26 to inhibit movement thereof, either in conjunction with or in place of rivets described with reference to FIG. 10. Likewise, the angled ridges 100, 180 and isometric ridges 102, 182 within the second panel receiving volume 208 engage the second structural member 28 to inhibit removal thereof.

Figure 12:
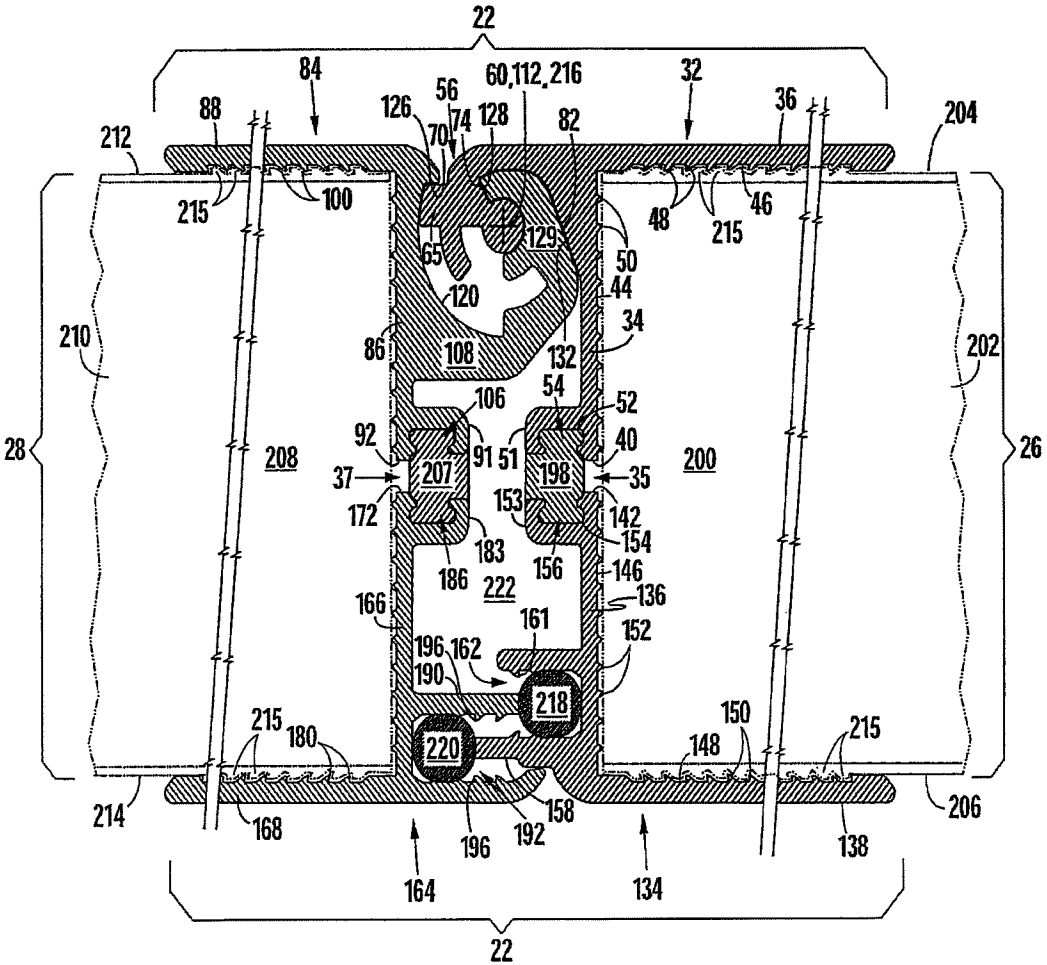
FIG. 12 and FIG. 13 shows the sectional view and an isometric view, respectively of the embodiment shown in FIG. 11, and further depicts individualized extruded teeth engaging the panel engaging members to inhibit removal of the panel assemblies from the panel receiving slots.
Figure 13:
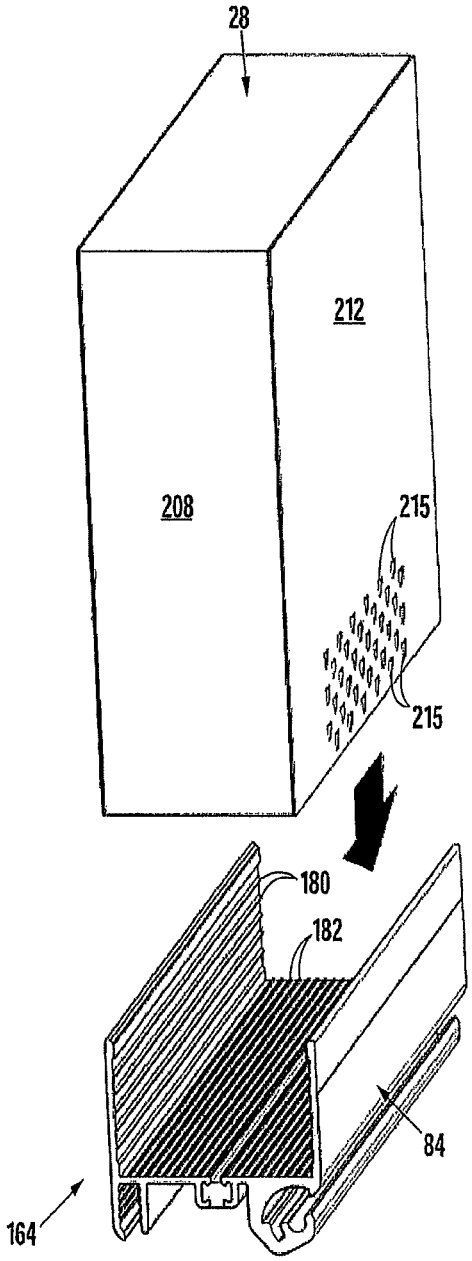

As shown in FIGS. 12-13, in other alternative embodiments, the panel assemblies 26, 28 may include similarly-shaped but oppositely-orientated individualized extruded teeth 215 formed in the metallic reinforcing layers 204, 206, 212, 214 that engage with the angled ridges 48, 100, 150, 180 to provide additional engagement functionality. In still other embodiments, individualized extruded teeth extending normally or at an angle into the panel receiving volumes from the engaging surfaces, the panel assemblies 26, 28 to engage teeth or ridges formed in the reinforcing layers 204, 206, 212, 214.

Referring back to FIG. 10, the first and second bearing members 56, 108 are rotatable with respect to one another so that the first and second panel assemblies 26, 28 may be rotated between the first relative position shown in FIG. 10 wherein the panel assemblies 26, 28 are aligned and the second relative position shown in FIG. 14 wherein the panel assemblies 26, 28 are in a perpendicular relationship.

When the panel assemblies 26, 28 are in the aligned position as shown in FIG. 10, the first and second insulating bodies 198, 207 and the first and second spaces 35, 37, create a thermal barrier across the hinge assembly 22. Thermal energy is inhibited from passing from the first and second bodies 32, 84 on one side of the hinge assembly 22 to the third and fourth bodies 134, 164 on the other side of the hinge assembly. The interior space 222 defined by the hinge assembly 22, is normally filled with air and also provides thermal insulation. Although the preferred embodiment is described as including the first and second insulating bodies 198, 207, alternative embodiments contemplate manufacture of the present invention without these thermal bodies 198, 207 when the intended installation site is at a temperate area.

Figure 15:
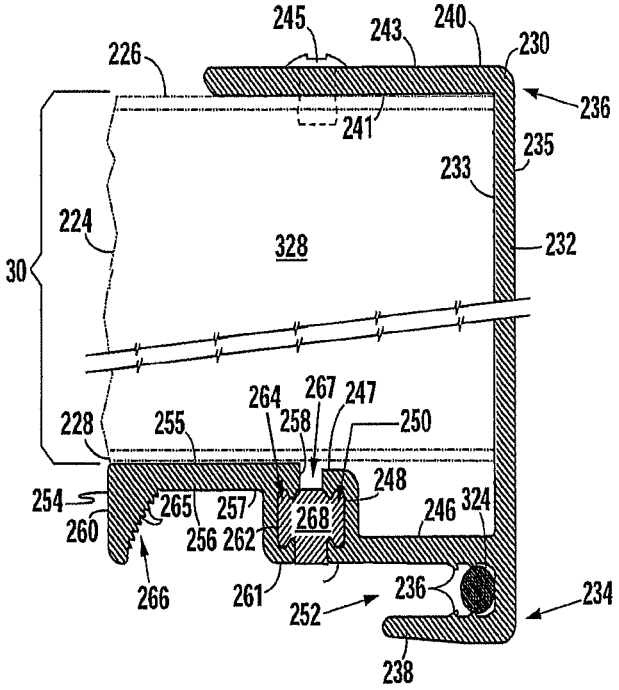
FIG. 15 is a sectional view of the elements of the preferred embodiment of the connection assembly shown in FIG. 1 from line 15-15 thereof.
Figure 16:
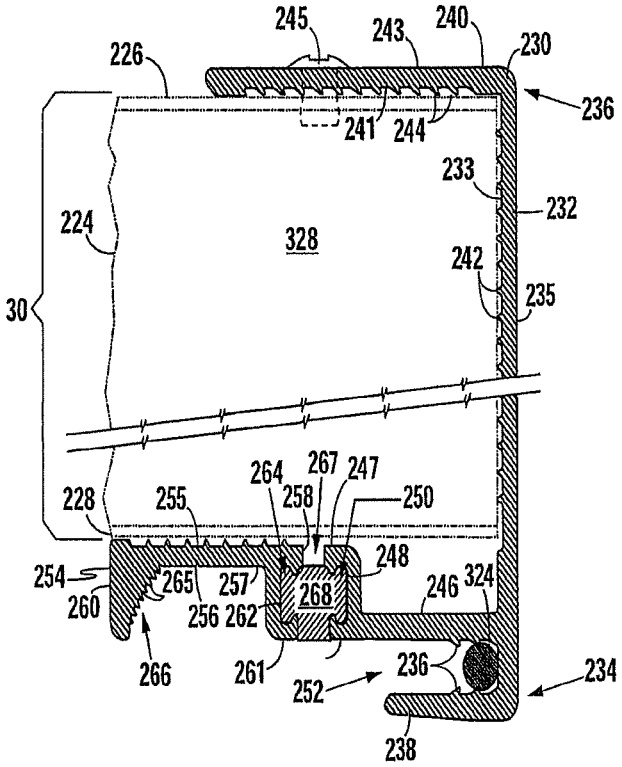
FIG. 16 is a sectional view of an alternative embodiment of FIG. 15, which further comprise panel engaging members extending into the respective panel receiving volumes.

FIG. 15 shows a sectional view of the first bracketing body 230 and second bracketing body 254 of the preferred embodiment of the connection assembly 24. The first bracketing body 230 and the second bracketing body 254 define a third panel receiving volume 328 have a square U-shaped cross section. The third panel assembly 30 is positioned within the third panel receiving volume 328. The third panel assembly 30 is preferably comprised of a layer of insulative core material 224 positioned between metallic reinforcing layers 226, 228.

The first bracketing body 230 comprises a base planar member 232 with a first end 234 and a second end 236. A first engagement fin 238 extends at a right angle from the first end 234 of the base planar member 232. A side planar member 240 extends at a right angle from the second end 236 of the base planar member 232. A second engagement fin 246 extends from the base member 232 at a position between the side planar member 240 and first engagement fin 238 at a right angle. The base planar member 232 and the side planar member 240 both have planar engaging surfaces 233, 241 and non-engaging surfaces 235, 243.

The first bracketing body 230 is preferably fixed to the panel assembly 328 with fasteners, such as a row of rivets 245. A first channel beam 247, having a generally C-shaped cross section, is positioned at and formed integrally with the free end of the second engagement fin 246. The first channel beam 247 has a curved concave interior surface 248 which defines a first insulating volume 250. The first engagement fin 238, the second engagement fin 246, and the base member 232 define a first sealing volume 252 having a generally square U-shaped cross section. Retaining members 226 are located within the first seal forming volume 252. In the preferred embodiment, the retaining members 196 are ridges. In alternative embodiments the retaining members 226 are a plurality of individualized extruded teeth.

As shown in FIG. 15, the second bracketing body 254 comprises a base planar member 256 with a first end 258 and a second end 260, a planar engaging surface 255 and a non-engaging surface 257. A second channel beam 261 having a generally C-shaped cross section is formed integrally with and positioned at the first end 258 of the base planar member 256. The second channel beam 261 has a curved concave interior surface 262 defining a second insulating volume 264. A locking engagement surface 266 extends from the non-engaging surface 257 at an angle proximal to the second end 260 of the base planar member 256. The locking engagement surface 266 has ridges 265 extending therefrom.

The second engagement fin 246 and the second bracketing body 254 are positioned with respect to each other such that the open ends of the first and second channel beams 247, 261 face each other with a space 267 between. The channel beams 247, 261 are mechanically connected by a rigid first insulating body 268 (i.e., a thermally-nonconductive, hardened resin) shaped to fit within the first and second insulating volumes 250, 264 and a portion of the space 267 between the channel beams 247, 261. In this manner, the second bracketing body 254 is fixed relative to, but not in direct contact with, the first bracketing body 230.

Figure 17:
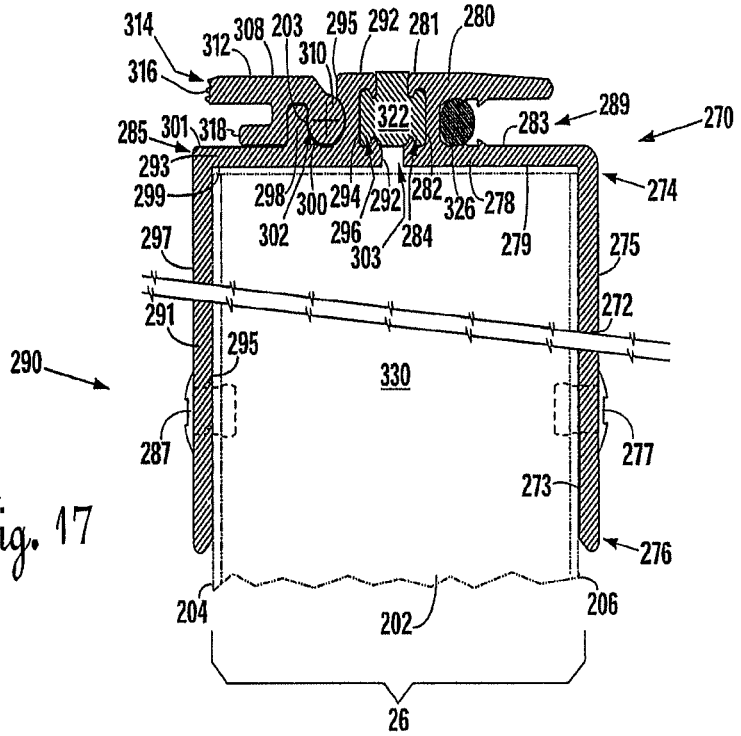
FIG. 17 is a sectional view of the elements of the preferred embodiment of the connection assembly shown in FIG. 1 from line 15-15 thereof.
Figure 18:
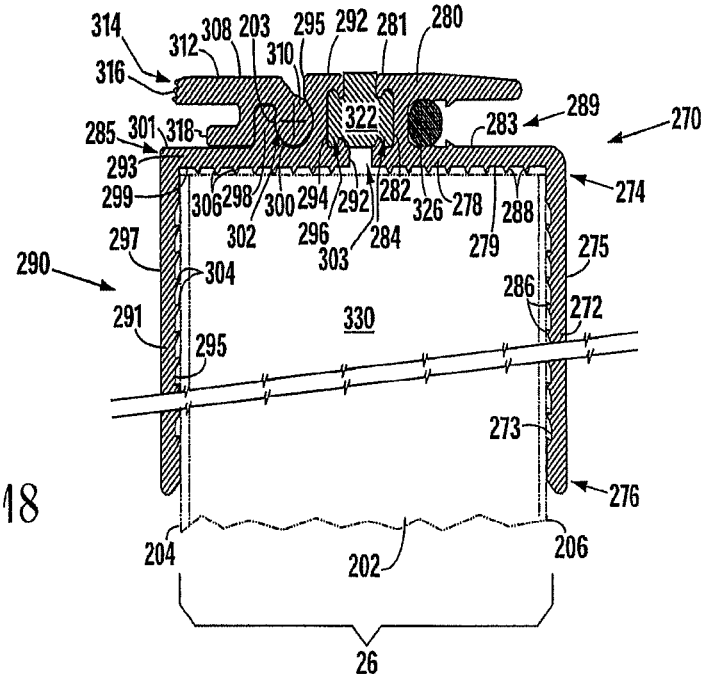
FIG. 18 is a sectional view of an alternative embodiment of FIG. 17, which further comprises panel engaging members extending into the respective panel receiving volumes.

FIG. 17 discloses a sectional view of a third bracketing body 270 and a fourth bracketing body 290 of the preferred embodiment of the connection assembly 24. The third bracketing body 270 and fourth bracketing body 290 define a fourth panel receiving volume 330 having a square U-shaped cross section. A second end of the first panel assembly 26 is positioned in the fourth panel receiving volume 330. The third bracketing body 270 having base planar member 272 with a first end 274, a second end 276, a planar engaging surface 273 and a non-engaging surface 275. A side planar member 278 extends at a right angle from the first end 274 of the base member 272 and also has an engaging surface 279 and a non-engaging surface 283.

A third channel beam 281 having a generally C-shaped cross section is formed integrally with and positioned at the free end of the side planar member 278. The third channel beam 281 has a concave curved interior surface 282 which defines a third insulating volume 284.

A third engagement fin 280 is formed integrally with and extends from the third channel beam 281 in a direction generally toward the base planar member 272. The third engagement fin 280 is spaced from and generally parallel with the side planar member 278 forming a second sealing volume 289 defined by the third engagement fin 280, the third channel beam 281 and the side planar member 278.

As shown in FIG. 17, the preferred embodiment of the connection assembly 24 includes a fourth bracketing body 290 with a base planar member 291 and side planar member 293 extending from one end 285 of the base planar member 291. The base planar member 291 has a planar engaging surface 295 and a non-engaging surface 297. The side planar member 293 also has a planar engaging surface 299 and non-engaging surface 301.

The fourth bracketing body 290 is preferably fixed to the panel assembly 330 with fasteners, such as a row of rivets 287. A fourth channel beam 292, having a generally C-shaped cross section, is formed integrally with and positioned at the free end of the side planar member 293. The fourth channel beam 292 has a concave curved interior surface 294 forming a fourth insulating volume 296. A partially-cylindrical bearing surface 300 is formed in the exterior surface 295 of the fourth channel beam 292, the non-engaging surface 301 of the side planar member 293 and a curved surface 203 of a bearing fin 298 extending from the non-engaging surface 301. The side planar member 278 of the third bracketing body 270 is positioned with respect to the side planar member 293 of the fourth bracketing body 290 such that the open ends of the third and fourth channel beams 281, 292 face each other with a space 303 therebetween. The channel beams 281, 292 are mechanically connected by a second insulating body 322 (i.e., a thermally-nonconductive, hardened resin) shaped to fit within the third and fourth insulating volumes 284, 296 and a portion of the space 303 between the channel beams 281, 292. In this manner, the third bracketing body 270 is fixed relative to, but not in direct contract with, the fourth bracketing body 290.

A locking member 308 having a hinge pin 310 at one end is rotatably connected to the third bracketing body 290 with the hinge pin 310 pivoting within the partially-cylindrical bearing surface 300 and occupying the corresponding partially-cylindrical volume 302 defined by the bearing surface 300. The locking member 308 includes a planar strut member 312 extending from the hinge pin 310 at one end and having a free second end 314. Ridges 316 are formed in the free second end 314 to correspond with the locking engagement surface 266 of the lock-engaging member 254 (see FIG. 15). A spacing fin 318 having an L-shaped cross-section extends from the planar strut member 312. The spacing fin 318 is positioned with respect to the hinge pin 310 such that the hinge pin 310 occupies the space between spacing fin 318 and the bearing fin 298 when the locking member 308 is in the unlocked position as shown in FIG. 17.

Figure 19:
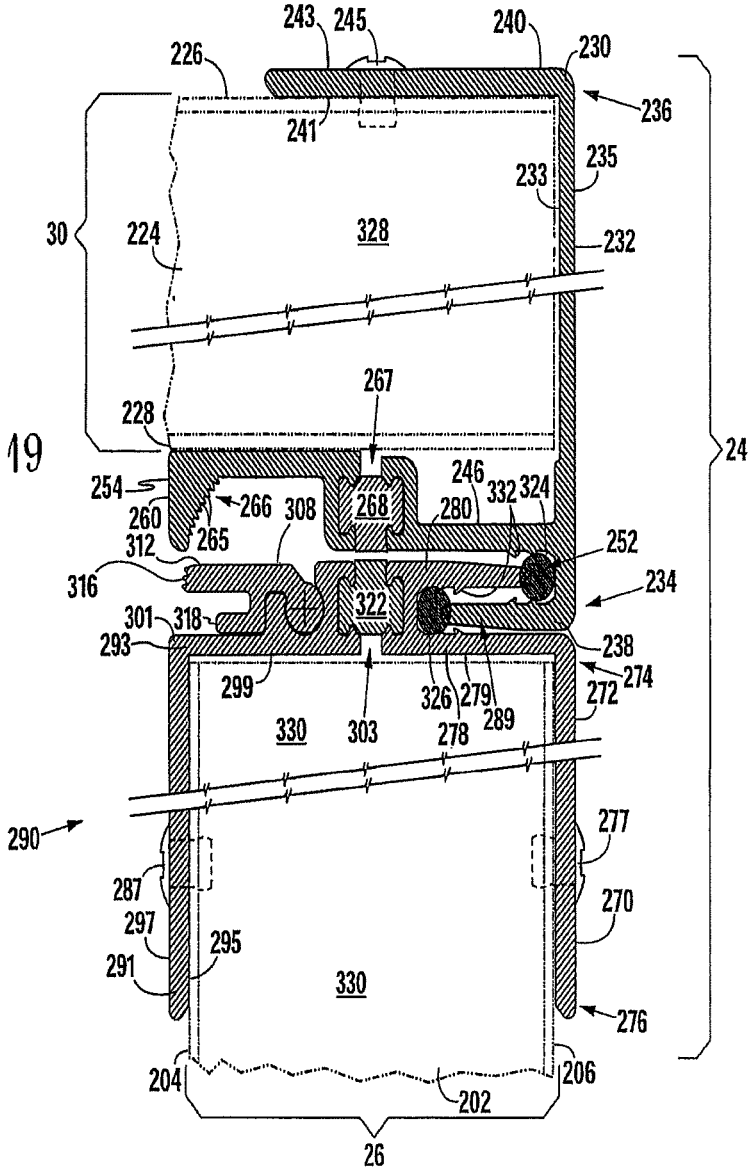
FIG. 19 is a sectional view of the connection assembly shown in FIG. 1 along line 15-15 thereof.
Figure 20:
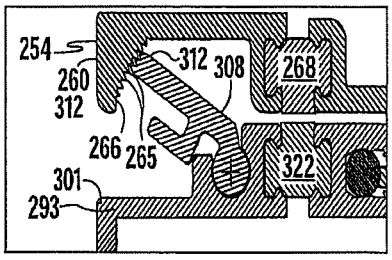
FIG. 20 is a section view shown in FIG. 19 with the locking member engaged with the lock engaging edges.

FIG. 19 depicts the connection assembly in a configuration where the first panel assembly 26 is connected to a third panel assembly 30 in a perpendicular alignment. This could occur in a building construction, for example, when a wall panel is mated with a ceiling panel. In this configuration, the first and second insulating bodies 268, 322 and the first and second spaces 267, 303 create a thermal barrier across the connection assembly 24. Thermal energy is inhibited from passing from the first and second bracketing bodies 230, 254 on one side of the connection assembly 24 to the third and fourth bracketing bodies 270, 290 on the other side.

In the configuration shown in FIG. 19, the first, second and third engagement fins 238, 246, 280 are arranged in a generally parallel, overlapping configuration with the third engagement fin 280 positioned in the first sealing volume 252 between the first and second engagement fins 238, 246 and the first engagement fin 238 positioned in the second sealing volume 289 between the side panel member 278 and the third engagement fin 280.

A rubber sealing element 324 is positioned in the first sealing volume and compressed therein by the third engagement fin 280. Sealing element 326 occupies the second sealing volume 289 and is compressed therein by the first engagement fin 238. In this manner, the sealing elements 324, 326 inhibit fluid flow into the interior space 330.

To use the connection assembly 24, the first and third panel assemblies 26, 30 are inserted into the fourth and third panel receiving volumes 330, 328, respectively, and fixed thereto with fasteners, such as rows of rivets 245, 277, 287.

As shown in FIG. 19, the locking member 308 is rotatable between a first position (shown in FIG. 9) and second position. In the first position, the ridges 316 of the locking member 308 are not engaged with the ridges 265 of the locking engagement surface 266 of the second bracketing body 254. In the second position, the ridges 316 are engaged with the ridges 265 of the locking engagement surface 266.

As described above, the sealing elements 324, 326 inhibit moisture and other fluids from passing through the connection assembly 24 between first and third panel assemblies 26, 30. In addition, the sealing elements 324, 326 create a biasing force that urges the first bracketing body 230 and the third bracketing body 270 apart and at the same time urges the ridges 316 of the locking member 308 into the ridges 365 of the locking engagement surface 266 of the second bracketing body 254. This inhibits inadvertent disengagement of the locking member 308 from the locking engagement surface 266. Retaining members 332 in the first and second sealing volumes 252, 289, respectively, inhibit egress of the sealing elements 324, 326 from those volumes.

Figure 21:
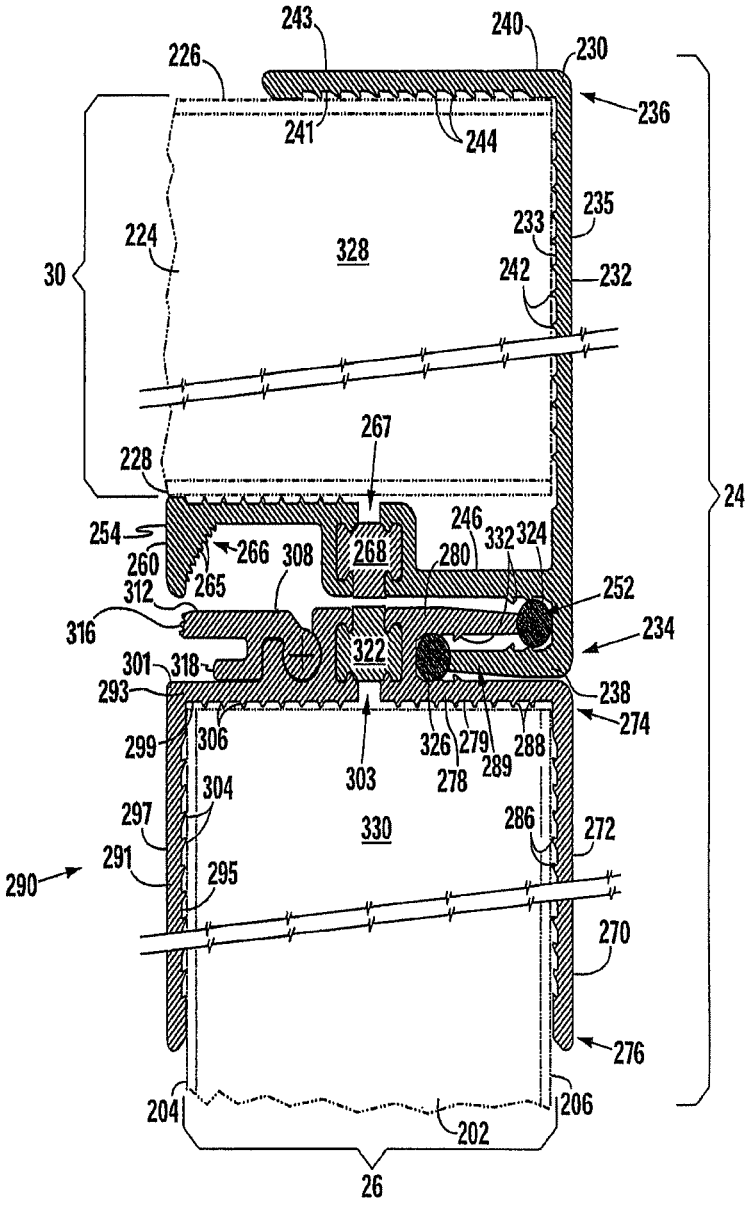
FIG. 21 is a sectional view of an alternative embodiment of FIG. 20 further comprising panel engaging members extending into the panel receiving volumes.

As shown in FIG. 21, in alternative embodiments, in addition to or instead of the rivets described with reference to FIG. 10, the engaging surfaces 233, 241 of the base planar member 232 and the side planar member 240 of the first bracketing body 230 have isometric ridges 242 and angled ridges 244, respectively, that engage the third panel assembly 30. Likewise, the engaging surfaces 295, 299 of the base planar members 291 and side planar members 293 of the fourth bracketing body 290 have angled ridges 304 and isometric ridges 306 that engage the first panel assembly 26, with the angled ridges 304 angled to resist movement of the first panel assembly 26 from the bracketing volume 330. The engaging surfaces 273, 279 of the base planar member 272 and the side planar member 278 of the third bracketing body 270 have angled ridges 286 and isometric ridges 288, respectively, that engage the first panel assembly 26, with the angled ridges 286 angled toward the side planar member 278. Other alternative embodiments of the invention contemplate a plurality of individualized extruded members extending normally or at an angle from the planar members, as described with reference to FIGS. 12-13.

The present invention is described above in terms of preferred illustrative embodiments of a specifically described interconnection system. Those skilled in the art will recognize that alternative constructions of such a system can be used in carrying out the present invention. Other aspects, features, and advantages of the present invention may be obtained from a study of this disclosure and the drawings, along with the appended claims.

I claim:

1. A panel connection assembly for interconnecting first and second panels and providing for rotation of said first panel with respect to said second panel around an axis of rotation between a first relative position and a second relative position, the panel connection assembly comprising:

a first bracketing body having first and second planar members and a first bearing member, said second planar member extending outwardly from said first planar member;

a second bracketing body having third and fourth planar members and a second bearing member pivotally engaged with the first bearing member, said fourth planar member extending outwardly from said third planar member, said second bearing member extending outwardly from said third planar member;

a third bracketing body having fifth and sixth planar members, said sixth planar member extending outwardly from said fifth planar member;

a fourth bracketing body having seventh and eighth planar members said eighth planar member extending outwardly from said seventh planar member;

a first thermal insulating body positioned between said first planar member of said first bracketing body and said fifth planar member of said third bracketing body, said first thermal insulating body separating said first and third bracketing bodies;

a second thermal insulating body positioned between said third planar member of said second bracketing body and said seventh planar member of said fourth bracketing body, said second thermal insulating body and separating said second and fourth bracketing bodies;

a first panel receiving volume at least partially defined by said first, second, fifth and sixth planar members of said first and third bracketing bodies, the first panel receiving volume adapted to receive the first panel such that the first panel is located between the second planar member of the first bracketing body and the sixth planar member of the third bracketing body; and a second panel receiving volume at least partially defined by said third, fourth, seventh and eighth planar members of said second and fourth bracketing bodies, the second panel receiving volume adapted to receive the second panel such that the second panel is located between the fourth planar member of the second bracketing body and the eighth planar member of the fourth bracketing body.

2. The panel connection assembly of claim 1 further comprising a first sealing element positioned between said fifth planar member of said third bracketing body and said seventh planar member of said fourth bracketing body.

3. The panel connection assembly of claim 1 wherein:

said first bearing member comprises a curved first bearing arm partially surrounding but spaced from a hinge pin; and said second bearing member comprises a curved second bearing arm that terminates in a hinge barrel partially encircling and engaging said hinge pin.

4. The panel connection assembly of claim 3 wherein the first bearing member further comprises:

a convex first bearing surface of said hinge pin having a first radius R1 from the axis of rotation;

at least one concave second bearing surface of said first bearing arm having a second radius R2 from the axis of rotation, wherein R2 is greater than R1;

a convex exterior third bearing surface of said first bearing arm having a third radius R3 from the axis of rotation, wherein R3 is greater than R2;

an end surface of said first bearing arm extending between the second and third bearing surfaces;

a stop member extending from the exterior third bearing surface of said first bearing arm;

said stop member comprising first and second opposing stopping surfaces extending between the third bearing surface and a convex fourth bearing surface.

5. The panel connection assembly of claim 4 wherein the second bearing member comprises:

a concave fifth bearing surface of said hinge barrel having a fifth radius R5 from the axis of rotation, equal to R1;

a convex sixth bearing surface of said hinge barrel having a sixth radius R6 from the axis of rotation, wherein R6 is greater than R5;

a convex seventh bearing surface of said hinge barrel having a seventh radius R7 from the axis of rotation, wherein R7 is greater than R5;

a concave eighth bearing surface of said second bearing arm having an eighth radius R8 from the axis of rotation, wherein R8 is greater than R7;

a concave ninth bearing surface having a ninth radius R9 from the axis of rotation, wherein R9 is greater than R8;

a first stopping surface extending between the seventh and eighth bearing surfaces;

and second and third stopping surfaces extending from the ninth bearing surface and positioned to contact the first and second opposing stopping surfaces respectively, of the stop member.

6. The panel connection assembly of claim 2 further comprising:

first and second fins extending from said fifth planar member of the third bracketing body and partially defining a first sealing volume therebetween, said first sealing element located in said first sealing volume;

third and fourth fins extending from said seventh planar member of the fourth bracketing body and partially defining a second sealing volume therebetween; and a second sealing element located in said second sealing volume.

7. The panel connection assembly of claim 1 further comprising a plurality of teeth extending into said first and second panel receiving volumes from at least one of said planar members.

8. The panel connection assembly of claim 6 wherein when said assembly is in the first relative position:

the first and second panel receiving volumes are aligned;

the first sealing element is compressed between the first and second fins of said third bracketing body by said fourth fin of the fourth bracketing body; and the second sealing element is compressed between the third and fourth fins of said fourth bracketing body by said first fin of the third bracketing body.

9. A panel connection assembly for interconnecting first and second panels and providing for rotation of said first panel with respect to said second panel around an axis of rotation between a first relative position and a second relative position, the panel connection assembly comprising:

a first bracketing body having first and second planar members and a first bearing member;

a second bracketing body having third and third fourth planar members and a second bearing member pivotally engaged with the first bearing member;

said first bearing member comprises a curved first bearing arm partially surrounding but spaced from a hinge pin;

said second bearing member comprises a curved second bearing arm that terminates in a hinge barrel partially encircling and engaging said hinge pin;

a convex first bearing surface of said hinge pin having a first radius R1 from the axis of rotation;

at least one concave second bearing surface of said first bearing arm having a second radius R2 from the axis of rotation, wherein R2 is greater than R1;

a convex exterior third bearing surface of said first bearing arm having a third radius R3 from the axis of rotation, wherein R3 is greater than R2;

an end surface of said first bearing arm extending between the second and third bearing surfaces;

a convex fourth bearing surface of said hinge barrel having a radius R7 from the axis of rotation;

a concave fifth bearing surface of said second bearing arm having a radius R8 from the axis of rotation, wherein R8 is greater than R7;

a stopping surface extending between the fourth and fifth bearing surfaces, said first bearing member adapted to be received between the fourth bearing surface and the fifth bearing surface of the second bearing member.

10. The panel connection assembly of claim 9 including a stop member extending from the third bearing surface of said first bearing arm, wherein said stop member comprises first and second stopping surfaces extending between the third bearing surface and a convex sixth bearing surface; and said sixth bearing surface having a radius R4 from the axis of rotation, wherein R4 is greater than R3.

11. The panel connection assembly of claim 10 wherein the second bearing member comprises:

a concave seventh bearing surface of said hinge barrel having a radius R5 from the axis of rotation, equal to R1;

a convex eighth bearing surface of said hinge barrel having a radius R6 from the axis of rotation, wherein R6 is greater than R5;

a concave ninth bearing surface having a radius R9 from the axis of rotation, wherein R9 is greater than R8;

an outer end surface of said hinge barrel extending between the seventh and eighth bearing surfaces; and second and third stopping surfaces extending from the ninth bearing surface and positioned to contact the first and second stopping surfaces respectively, of the stop member.

12. The panel connection assembly of claim 9 further comprising:

a third bracketing body having fifth and sixth planar members;

a fourth bracketing body having seventh and eighth planar members;

a first thermal insulating body positioned between and separating said first and third bracketing bodies;

a second thermal insulating body positioned between and separating said second and fourth bracketing bodies;

a first panel receiving volume at least partially defined by said first, second, fifth and sixth planar members of said first and third bracketing bodies; and a second panel receiving volume at least partially defined by said third, fourth, seventh and eighth planar members of said second and fourth bracketing bodies.

13. The panel connection assembly of claim 10 further comprising a first sealing element positioned between said third bracketing body and said fourth bracketing body.

14. The panel connection assembly of claim 13 further comprising:

first and second fins extending from the third bracketing body and partially defining a first sealing volume therebetween;

third and fourth fins extending from the fourth bracketing body and partially defining a second sealing volume therebetween;

said first sealing element occupying the first sealing volume; and a second sealing element occupying the second sealing volume.

15. The panel connection assembly of claim 10 further comprising a plurality of teeth extending into said first and second panel receiving volumes from at least one of said planar members.

16. The panel connection assembly of claim 14 wherein when said assembly is in the first relative position:

the first and second panel receiving volumes are aligned;

the second sealing element is compressed between the first fin and the fourth bracketing body; and the first sealing element is compressed between the fourth fin and the third bracketing body.

* * * * *